United States Patent [19]

Chesebro

[11] Patent Number: 4,755,822

[45] Date of Patent: Jul. 5, 1988

[54] ANTENNA MOUNTING

[75] Inventor: Stephen B. Chesebro, Brewerton, N.Y.

[73] Assignee: RCA Licensing Corporation, Princeton, N.J.

[21] Appl. No.: 927,204

[22] Filed: Nov. 5, 1986

[51] Int. Cl.[4] ..... H01Q 1/24

[52] U.S. Cl. ..... 343/702; 343/878; 343/888

[58] Field of Search ..... 343/702, 878, 888

[56] References Cited

U.S. PATENT DOCUMENTS

| | | | |
|---|---|---|---|
| 2,319,760 | 5/1943 | Becwar | 343/888 |
| 2,396,121 | 3/1946 | Patino | 343/702 |
| 2,439,408 | 4/1948 | Mitchell | 343/888 |
| 2,497,687 | 2/1950 | Pickett et al. | 343/888 |
| 2,833,849 | 5/1958 | Abel | 343/888 |
| 3,484,696 | 12/1969 | Taylor et al. | 343/702 |
| 3,512,162 | 5/1970 | Siebold et al. | 343/702 |

*Primary Examiner*—William L. Sikes
*Assistant Examiner*—Hoanganh Le
*Attorney, Agent, or Firm*—Paul J. Rasmussen; Peter M. Emanuel; Thomas F. Lenihan

[57] ABSTRACT

A low cost antenna mount is disclosed for mechanically securing an antenna to an electronic device and simultaneously providing assurance of good electrical contact with the input circuitry of the device. An antenna base (1) with a machined groove (2) is inserted through a hole (4) in a molded plastic antenna housing (5). An integral electrical contact and cam follower (7) is secured to the interior of the antenna housing (5). A cam (15) is used for moving the integral electrical contact (7) and cam follower (7) into mechanical and electrical contact with the antenna base (1). The cam follower (7) is formed from a single strip of spring metal and is bent at three places to form a guide (6) for receiving the antenna base (1) as it is inserted into the hole (4) in the antenna mount. The cam follower (7) is biased to follow the inclined surface of the cam (15) as it is rotated to securely lock the antenna base (1) in place and simultaneously make good electrical contact therewith. The distinguishing characteristics of the invention are the ease of installation and removal of the antenna to electrical circuitry such as a radio or other communications device and the simplicity of its structure. An integral electrical contact (11) at one end of a cam follower (7) and a cam (15) are the major parts of this invention. The cost of manufacture is minimized by using such a simple structure, and reducing the number of parts and the number of operations required for assembly.

8 Claims, 3 Drawing Sheets

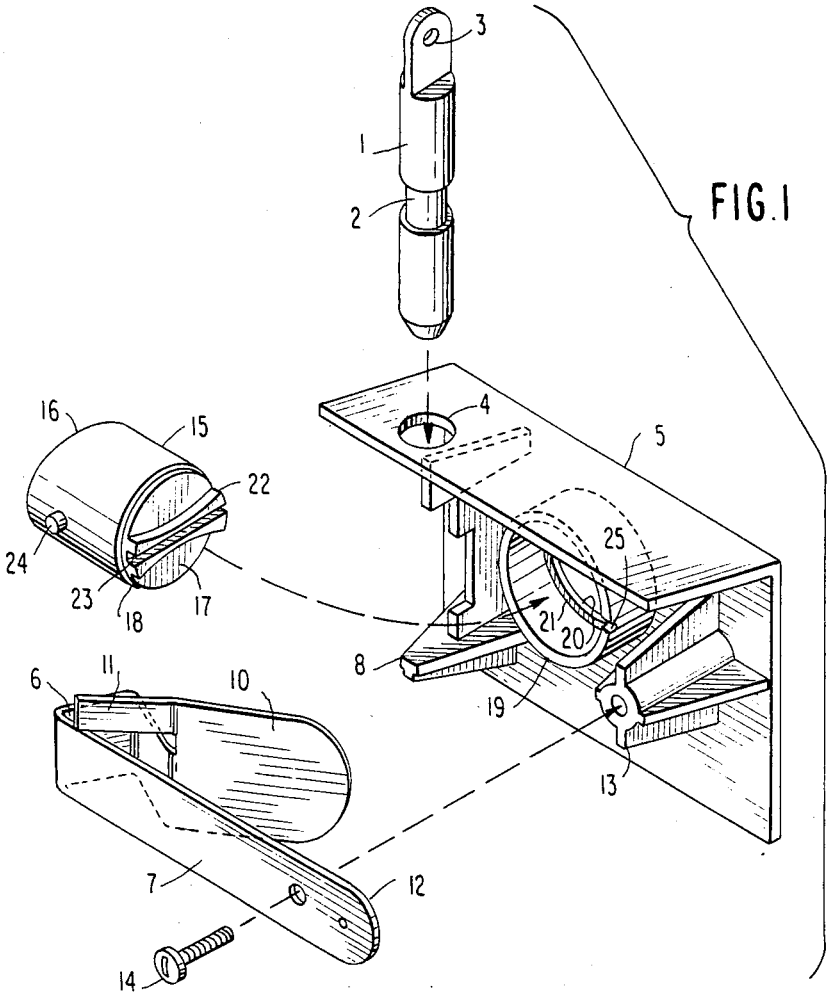
FIG. 1
FIG. 2
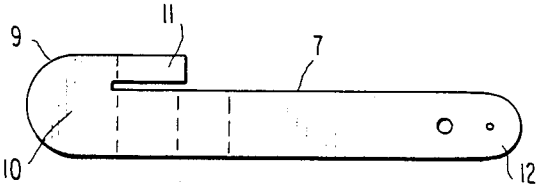

ANTENNA MOUNTING

BACKGROUND OF THE INVENTION

1. Field of the Invention

This invention is generally directed to an apparatus for securing an antenna and, more particularly, to a housing for mounting the antenna of the rod type and simultaneous assurance of electrical contact with the input circuitry structure.

2. Description of the Prior Art

The technology from which the antenna mounting technique drew its origins is the technology of radio, television and automobile antenna securing devices. The prior art required screw mounting the antenna in place. This made assembly and maintenance a time consuming ordeal.

In the past, many products did not take ease of manufacturing into account in the design. Most antenna mounts required that a number of holes be drilled to secure the antenna. In the case of automobile and portable radio antennas, it was often necessary to employ multiple reinforcements to securely hold the antenna in place. Different models and styles of cars and radios often required modified antenna mounting techniques to accommodate the antenna. An antenna must make good connection with the input circuitry in order to facilitate clear reception. A separate screw and connecting wire was commonly employed to secure the input circuitry to the antenna. Installation of antennas representative of the prior art was often a complex and time consuming process.

SUMMARY OF THE INVENTION

It is therefore an object of the present invention to provide a secure and cost effective arrangement for mounting an antenna in a radio housing.

It is another object of this invention to provide a housing to assure proper location of the antenna and electrical contact with the input circuitry structure.

According to the invention, these objects are accomplished by providing an antenna base, an antenna housing having a hole for receiving the antenna base, an integral electrical contact and cam follower secured to the interior of the housing and forming a guide for receiving the antenna base as it is inserted into the hole in the housing, and a cam for moving the integral electrical contact and cam follower into mechanical and electrical engagement with the antenna base. The housing and cam are preferably made of plastic, the cam being a single molded piece. The integral electrical contact and cam follower is made of spring metal and biased to follow an inclined surface of the cam as it is rotated to securely lock the antenna base in place and simultaneously make good electrical contact therewith. The antenna may be easily released by again rotating the cam so as to release the spring bias of the cam follower and thereby allow the antenna base to be withdrawn from the housing. The cam is itself held in position within the housing by the integral electrical contact and cam follower which holds the cam against circumferential shoulders of an opening through which a portion of the cam projects. An optional rib can be used to prevent the cam follower from deflecting from the housing. The follower is bent at one end to make contact with a run on a printed circuit board. The portion of the cam which projects through the opening provides a means whereby the cam may be physically engaged for manual rotation. This may be a projection or a slot or both allowing manual grasping or insertion of a tool such as a screw driver or a coin. Further, the cam is provided with a projection on its side which matingly engages a notch in the opening that, together with the spring bias of the integral electrical contact and cam follower, forms a detent when the cam is in the locked position. The cam is released from this detent position by turning the cam with the previously mentioned coin or other tool.

The invention is characterized not only by the ease of installation and removal of an antenna to electrical circuitry such as a radio or other communications device, but also by the simplicity of its structure. The invention comprises only two major parts, the integral electrical contact and cam follower and the cam, which are mounted within a housing. This simplicity of structure decreases the cost of manufacture by minimizing the number of parts and the operations required for assembly.

BRIEF DESCRIPTION OF THE DRAWINGS

The foregoing and other objects, aspects and advantages of the invention will be better understood from the following detailed description of a preferred embodiment with reference to the drawings, in which:

FIG. 1 is an exploded view of the antenna mount according to the invention;

FIG. 2 is a plan view showing the stamped blank from which the follower is formed;

DETAILED DESCRIPTION OF THE PREFERRED EMBODIMENT OF THE INVENTION

Figure 6:
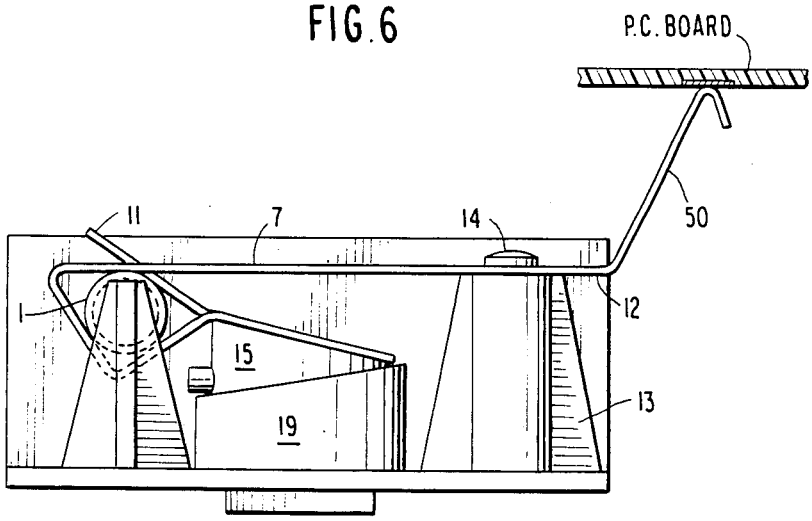
FIG. 6 is a side view of the antenna mount showing the electrical connection to the printed circuit board.
Figure 3:
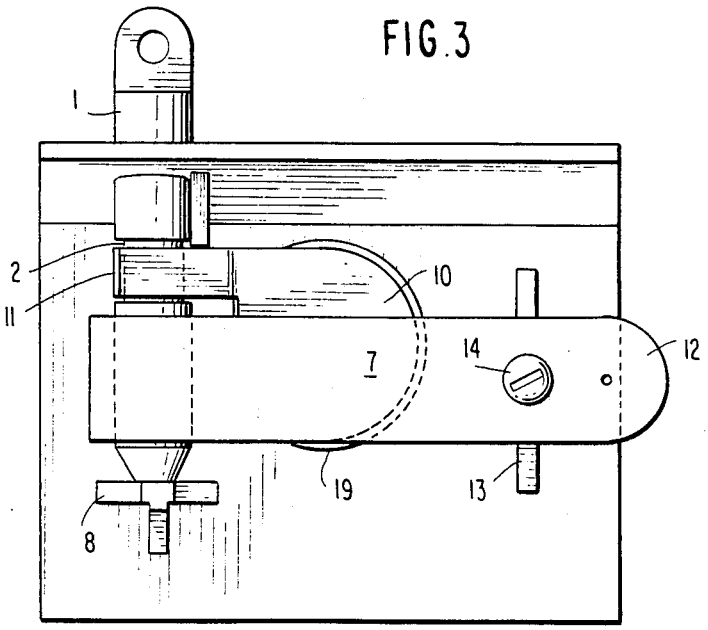
FIG. 3 is a side view of the antenna mount.

In the drawings, like reference numerals indicate the same parts in the several figures. Referring now to the drawings, and more particularly to FIGS. 1 and 3, the antenna base 1 is a cylindrically shaped, solid piece of metal with a machined groove 2 to receive a thin, flat piece of metal. The top of the antenna base 1 has a hole 3 for attaching the antenna. The antenna (not shown) may be a telescoping whip or rod antenna of conventional design. The specific design of the antenna does not form a part of the invention. The antenna base 1 slides through a hole 4 in the antenna housing 5 and then through a folded area 6 of the follower 7 and comes to rest on the projection 8 integral with the interior of housing 5. As shown in FIG. 2, the follower 7 is made from a single flat piece of spring metal. One end 9 of the follower 7 is bent in three places as indicated by the dotted lines in FIG. 2, the first two bends forming the end into a generally U-shape and the third bend causing the extreme end to incline slightly outwardly as depicted in FIG. 1. This bending results in a folded area 6 of the follower 7 which receives the antenna base 1. The inclined end 10 of the follower 7 has a larger area and includes a follower tab 11 which is a little narrower than the machined groove 2 of the antenna base 1. The other end 12 of the follower 7 is secured to an interior projection 13 of the housing 5 by means of a screw 14. The overhanging portion of the end 12 is provided with a through hole into which a wire connection may be inserted and soldered or an end 50, as depicted in FIG. 6, can be bent to make contact with a run on a printed circuit board. This would eliminate the requirement for a soldering operation and further reduce the cost of manufacture.

The follower tab 11 and the folded area 6 hold the antenna base 1 in place when biased into the locking position by the cam 15. The cam 15 is a single molded piece of generally cylindrical shape. One end 16 of the cam is generally planar and formed at an oblique angle to the axis of the body of the cam. The other end 17 of the cam is of smaller diameter than the main body of the cam, the transition between the main body of the cam and the smaller diameter end 17 forming a circumferential shoulder 18. The housing 5 is formed with an inwardly projecting circular flange 19, forming a cam housing and having an inside diameter sufficiently large to receive and allow the main body of the cam 15 to rotate within the cam housing. The cam housing 19 is located midway between the projection 8 and 13. A circular opening 20 is provided in the housing 5 concentric with the cam housing 19, and this opening is just large enough to permit the smaller diameter end 17 of the cam 15 to project through the housing. The interior of the housing 5 between the interior surface of the cam housing 19 and the opening 20 forms a shoulder 21 which matingly engages the shoulder 18 of the cam 15. The face of the smaller diameter end 17 of the cam 15 is provided with a projection 22 and a slot 23 allowing for grasping by fingers or pliers or the insertion of a tool such as a screw driver or a coin to facilitate the rotation of the cam. The inclined end 10 of the follower 7 holds the cam 15 in the flange 19. The cam 15 is provided with a projection 24 which matingly engages a notch 25 in the flange 19 under the urging of the spring bias of the inclined end 10 of the follower 7 when the cam is turned to the locking position. The projection 24 and notch 25 cooperate to form a detent, and the cam 15 may be released from the detent position by applying a moderate turning force to projection 22, or slot 23 and rotating the cam 15.

Figure 1A:
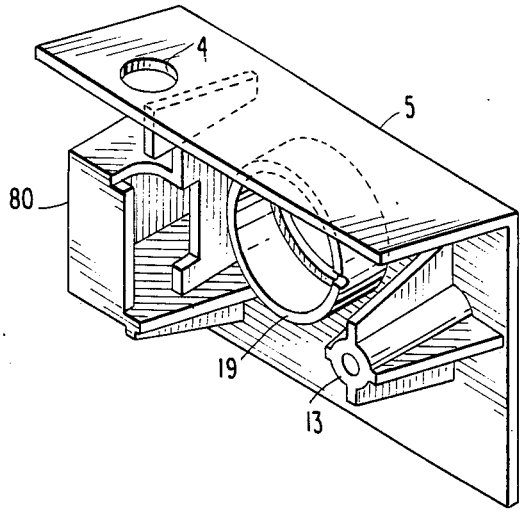
FIG. 1A is a perspective view of the antenna mount shown in FIG. 1 with an additional optional rib.

In FIG. 1A, an optional rib 80, incorporating the projection 8, is added to form a guide for receiving the antenna base 1. In addition, the rib 80 surrounds and secures the cam follower 7.

Figure 4:
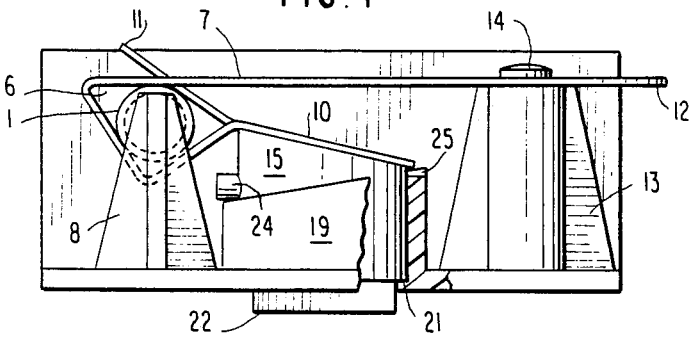
FIG. 4 is a bottom view of the antenna mount in the unlocked position.

FIG. 4 shows the antenna mount from the bottom in the unlocked position. The antenna base 1 is held by the follower tab 11 and the folded area 6 of the follower 7. In the unlocked position, the follower tab 11 is moved away from the groove 2 in the antenna base 1 so that the antenna base may be easily inserted and withdrawn without interference. The folded area 6 of the follower 7 is also relaxed, providing a wider opening for receiving the antenna base 1.

Figure 5:
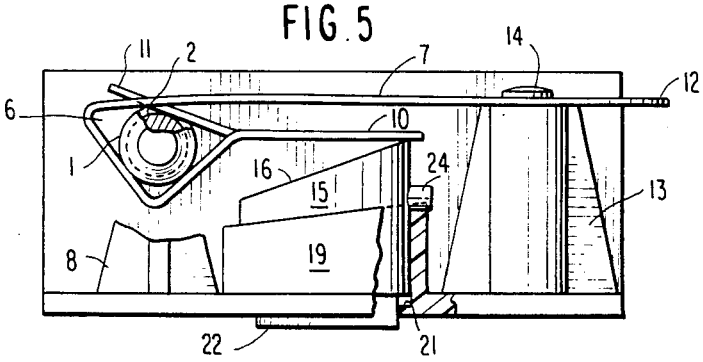
FIG. 5 is a bottom view of the antenna mount in the locked position.

As the cam 15 is rotated from the position shown in FIG. 4 to the locked position shown in FIG. 5, the cam's oblique end 16 applies pressure to the inclined end 10 of the follower 7 and forces the follower tab 11 securely onto the machined groove 2 of the antenna base 1. At the same time, the folded area 6 is contracted about the antenna base 1 further enhancing the mechanical and electrical contact between the antenna base 1 and the follower 7. A secure mechanical lock of the antenna base is assured by the follower tab 11 engaging the shoulders of the the machined groove 2 and the detent action of the projection 24 in notch 25. As depicted in FIG. 7, the rib 80 is used to prevent the follower 7 from deflecting from the housing when the cam 15 is in the locked position.

Assembly of the improved antenna mount is as follows. The cam 15 is slipped into the cam housing 19. The follower 7 is attached to the projection 13 by means of a screw so that the cam 15 is captured in the cam housing 19. This is all that is required to assemble the antenna mount. Once assembled, the antenna is installed by sliding the antenna base 1 through the hole 4 in the housing 5 and the folded area 6 of the follower 7 until it makes contact with the projection 8 integral to the housing 5. The cam 15 is then rotated to cause the follower tab 11 to engage the groove 2 in the antenna base 1 as bias is applied to the inclined end 10 of the follower 7.

A good electrical connection is assured between the antenna base and the cam follower 7 by the machined groove 2 of the antenna base 1 that receives the follower tab 11 and the pressure from the constriction of the folded area 6 as a result of the rotation of cam 15. Disassembly is facilitated by turning the cam to the unlocked position. When in the unlocked position, the antenna base 1 may then be easily withdrawn.

It will be apparent to one of ordinary skill in the art that any standard antenna rod, either the telescopic type or the standard fixed length rod may be accommodated by this apparatus. It will also be apparent that the services of a skilled technician should not be required to locate and install the antenna.

Although a preferred embodiment of the invention has been described, those skilled in the art will recognize that this invention may be practiced with modification to meet particular applications within the spirit and scope of the appended claims.

Having thus described my invention, what I claim as new and desire to secure by Letters Patent is as follows:

1. An improved antenna mount for simultaneously mechanically securing and providing electrical contact of an antenna with a rod-like base to electronic circuitry, said mounting comprising:

a housing comprising an insulating body including a wall and an interior projection having a surface parallel to said wall;

said wall of said housing having a hole therethrough for receiving said rod-like base, housing having an interior projection opposite said hole said rod-like base resting on said parallel interior projection surface after being received by said housing;

an integral electrical contact and cam follower secured to the interior of said housing, said integral electrical contact and cam follower comprises a member disposed between said hole in said wall of said housing 7 and said interior projection for selectively contacting said rod-like base, said member being mounted for movement between a first position wherein said member does not prevent the movement of said rod-like base, and a second position wherein said member inhibits the movement of said rod-like base; said electrical contact between said electronic circuitry and said rod-like base being established when said member is in said second position; and cam means mounted for rotation within said housing and operable from the outside of said housing for engaging and selectively moving said member of said integral electrical contact and cam follower between said first and second positions.

2. An improved antenna mount as recited in claim 1 wherein said integral electrical contact and cam follower is provided with a projecting tab and said rod-like base has formed therein a groove for receiving said tab, said cam means causing said tab to move into said groove when said integral electrical contact and cam follower is moved into locking engagement with said rod-like base.

3. An improved antenna mount as recited in claim 1 wherein said cam has a generally cylindrical one end of which is provided with an inclined surface that engages said integral electrical contact and cam follower and the other end of which is of a smaller diameter than said body, said housing having an inwardly projecting circular flange for receiving said cam body and an opening concentric with said flange through which said smaller diameter end projects, said cam being engaged from outside said housing for rotation within said flange.

4. An improved antenna mount as recited in claim 3 wherein said cam has a projection and said housing is provided with a notch in the vicinity of said opening for matingly engaging said projection under a spring bias provided by said integral electrical contact and cam follower when said cam is rotated to its locked position.

5. An improved antenna mount as recited in claim 1 wherein said integral electrical contact and cam follower is made from a single flat piece of spring metal which is bent to form said member.

6. An improved antenna mount as recited in claim 5 wherein said rod-like base is formed with a groove about its periphery and said integral electrical contact and cam follower is further provided with a projecting tab that matingly engages said groove when said integral electrical contact and cam follower is moved into locking engagement with said rod-like base.

7. An improved antenna mount as recited in claim 5 wherein said housing is formed with a rib that encloses said antenna base and said integral electrical contact and cam follower and prevents said integral electrical contact and cam follower from deflecting away from said housing.

8. An improved antenna mount as recited in claim 1 wherein said integral electrical contact and cam follower is made from a single flat piece of spring metal which is bent to make contact with a circuit board.

* * * * *